US008434780B2

(12) United States Patent
Li

(10) Patent No.: US 8,434,780 B2
(45) Date of Patent: May 7, 2013

(54) ROLLATOR

(75) Inventor: Qingfeng Li, Nanhai Foshan (CN)

(73) Assignee: Genteel Homecare Products Co., Ltd., Guangdong (CN)

( * ) Notice: Subject to any disclaimer, the term of this patent is extended or adjusted under 35 U.S.C. 154(b) by 436 days.

(21) Appl. No.: 12/881,511

(22) Filed: Sep. 14, 2010

(65) Prior Publication Data

US 2011/0193305 A1 Aug. 11, 2011

(30) Foreign Application Priority Data

Feb. 9, 2010 (CN) ..... 2010 2 0117441 U

(51) Int. Cl.
*B62B 3/02* (2006.01)
*A61H 3/04* (2006.01)
*A47D 13/04* (2006.01)

(52) U.S. Cl.
USPC ..... 280/639; 280/47.34; 280/47.41; 135/67; 297/5

(58) Field of Classification Search ..... 280/638, 280/639, 651, 47.34, 47.35, 47.371, 47.41, 280/7.1, 7.15; 135/67, 74; 297/5, 6, 331
See application file for complete search history.

(56) References Cited

U.S. PATENT DOCUMENTS

| | | | | |
|---|---|---|---|---|
| 1,358,235 | A * | 11/1920 | Nylin | 280/47.34 |
| 1,956,261 | A * | 4/1934 | Wagner | 280/651 |
| 5,251,925 | A * | 10/1993 | Haley, Sr. | 280/641 |
| 6,478,326 | B1 * | 11/2002 | Lee | 280/639 |
| 6,834,872 | B2 * | 12/2004 | Chen | 280/87.021 |
| 7,445,231 | B1 * | 11/2008 | Tsai | 280/655 |
| 7,828,305 | B2 * | 11/2010 | Meyers et al. | 280/87.021 |
| 8,070,180 | B2 * | 12/2011 | Stiba | 280/648 |
| 8,220,823 | B2 * | 7/2012 | Queen | 280/650 |
| 2008/0129016 | A1 * | 6/2008 | Willis | 280/639 |
| 2009/0033052 | A1 * | 2/2009 | Bradshaw et al. | 280/87.021 |

* cited by examiner

*Primary Examiner* — John R Olszewski
(74) *Attorney, Agent, or Firm* — Dickstein Shapiro LLP

(57) ABSTRACT

A rollator is disclosed in this invention. The rollator includes: a base frame; front wheel assemblies and rear wheel assemblies respectively mounted on both sides of the base frame; an inverted U-shaped supporting pipe; a H-shaped armrest bracket; connection pieces having block grooves thereon; a slide control lever for cooperating with the block grooves; a seat plate; a spring element; wherein the base frame is provided with unidirectional hinged seats; both bottom ends of the supporting pipe are hinged to the base frame, and both side arms of the supporting pipe are provided with slide holes facing each other; the armrest bracket has bottom portions hinged to the unidirectional hinged seat. The rollator has a simple structure and can be used for various situations in both folded and unfolded state.

5 Claims, 3 Drawing Sheets

ROLLATOR

FIELD OF THE INVENTION

The present invention relates to a rollator, and in particular to a foldable rollator.

BACKGROUND OF THE INVENTION

A rollator is made for the persons who have functional disorder in their lower limbs and who can not use crutches or canes. The main function of the rollator is to support the body weight of the user and to keep the balance of the human body, so as to assist the user in standing and walking. There are mainly two types of the rollator, i.e. fixed rollator and foldable rollator. For the convenience for the user to have a rest during walking, an integrated seat plate is usually provided. Normally, the foldable rollator which is adapted to be rotated inwards or folded longitudinally has a reduced width after folding, and is only adapted to be stored after folding and can not be used for other purposes.

SUMMARY OF THE INVENTION

It is an object of the present invention to provide a rollator which can be used in both unfolded and folded states.

To achieve the above object, the technical solution of the present invention is as follows:

a rollator comprises: a base frame; front wheel assemblies and rear wheel assemblies respectively mounted on both sides of the base frame; an inverted U-shaped supporting pipe; a H-shaped armrest bracket; connection pieces having block grooves thereon; a slide control lever for cooperating with the block grooves; a seat plate; a spring element; wherein the base frame is provided with unidirectional hinged seats; both bottom ends of the supporting pipe are hinged to the base frame, and both side arms of the supporting pipe are provided with slide holes facing each other; the armrest bracket has bottom portions respectively hinged to the unidirectional hinged seats; one end of each of the connection pieces is connected to the armrest bracket, while the other end of each of the connection pieces is hinged to the supporting pipe at a position below the slide holes; both ends of the slide control lever are respectively received in the slide holes on both side arms of the supporting pipe; one end of the spring element is mounted on the supporting pipe, while the other end is mounted on the slide control lever; one end of the seat plate is hinged to the armrest bracket, while the other end is a free end leaning on the supporting pipe.

The bottom ends of the armrest bracket are respectively hinged to the unidirectional hinged seats, and thus the rotation is unidirectional. The supporting pipe is also hinged to the base frame, the slide control lever on the supporting pipe is adapted to be slid into the block groove and stably retained in the block groove under the action of the spring force, in this way the supporting pipe and the armrest bracket are fixed via the connection pieces, the seat plate is supported between the armrest bracket and the supporting pipe, it is thus convenient for use. When folding, the spring force of the spring element is overcame to allow the slide control lever to disengage with the block groove, so that the connection pieces can be moved with respect to the armrest bracket and the supporting pipe, the armrest bracket and the supporting pipe can also be moved backwards with respect to the base frame to enable the rollator to be folded, the folded rollator has the same width as the rollator in unfolded state, but the height of the rollator is reduced. Articles can be placed on the folded rollator, and the folded rollator can be used as a platform cart. Therefore, the rollator is convenient for use in both unfolded and folded states in various situations.

Preferably, the rollator further comprises a shelf hinged to a bottom portion of the armrest bracket on both sides. The shelf is used for holding articles. The folded rollator can be stood to enable the rollator to be pushed forwards through the front wheel assembly, and the height in use is comfortable.

Preferably, the front wheel assembly comprises a wheel shaft mounted on the base frame with a direction limiter therebetween. The direction limiter can regulate the moving direction of the front wheel assembly such that it can be rotated by 360 degree in unfolded state and be limited in a single direction when being moved forwards in folded state.

Preferably, the direction limiter comprises a follower having a recess mounted on the wheel shaft, a button having a cam portion, a control rod and a spring, wherein one end of the control rod extends through the base frame and is hinged to the cam portion of the button, the other end of the control rod is cooperated with the recess; one end of the spring is mounted on the base frame, while the other end of the spring is mounted on the control rod. The control rod is hinged to the cam portion of the button, and can be moved up and down in vertical direction while the cam portion is rotated, and when the control rod is moved to the recess of the follower, the rotation of the wheel shaft is limited to realize the position limitation in a single direction. This structure is simple, and convenient in operation.

Preferably, a stepped portion is provided on an end of the control rod for cooperating with the recess so as to provide sufficient structure strength and to resist the shearing force. The direction limiting effect is significant.

With the present invention, the structure of the rollator is simple, the width of the rollator in the folded state remains the same as that in the unfolded state while the height is reduced, the rollator can be used for various situations in both folded and unfolded state, and moreover the operation is quite simple.

1. base frame, 2. supporting pipe, 3. slide hole, 4. front wheel assembly, 5. rear wheel assembly, 6. armrest bracket, 7. connection piece, 8. the second connection piece, 9. block groove, 10. slide control lever, 11. seat plate, 12. spring element, 13. the first armrest pipe, 14. the second armrest pipe, 15. shelf, 16. bracket pipe, 17. stand pipe, 18. wheel shaft, 19. button, 20. cam portion, 21. follower, 22. recess, 23. control rod, 24. stepped portion, 25. shaft hole, 26. nut, 27. cover, 28. spring, 29. the first hinged piece, 30. the second hinged piece, 31. protrusion, 32. unidirectional hinged seat.

DETAILED DESCRIPTION OF THE PREFERRED EMBODIMENTS

Figure 1:
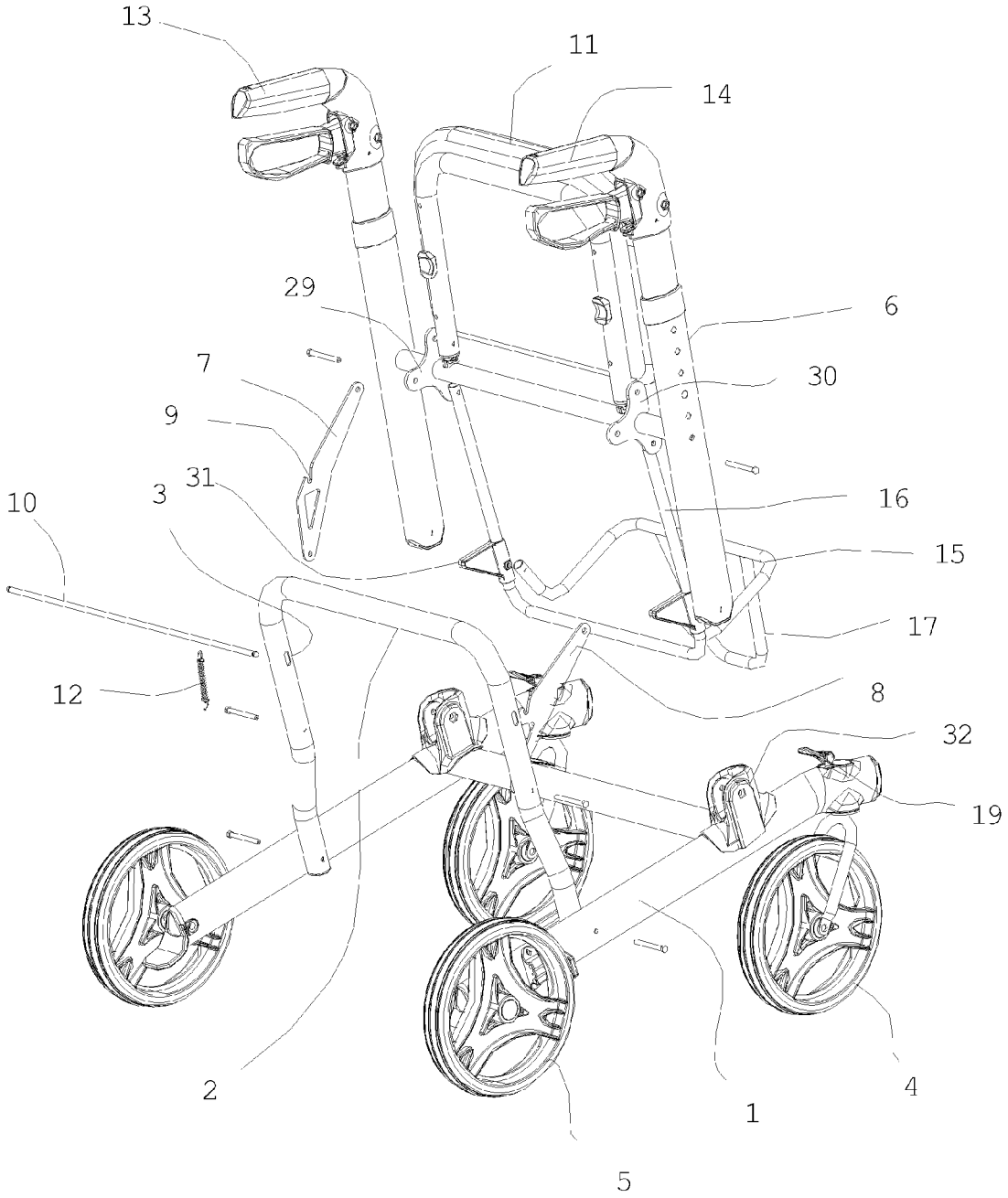
FIG. 1 is an exploded view of a rollator according to an embodiment of the present invention.
Figure 5:
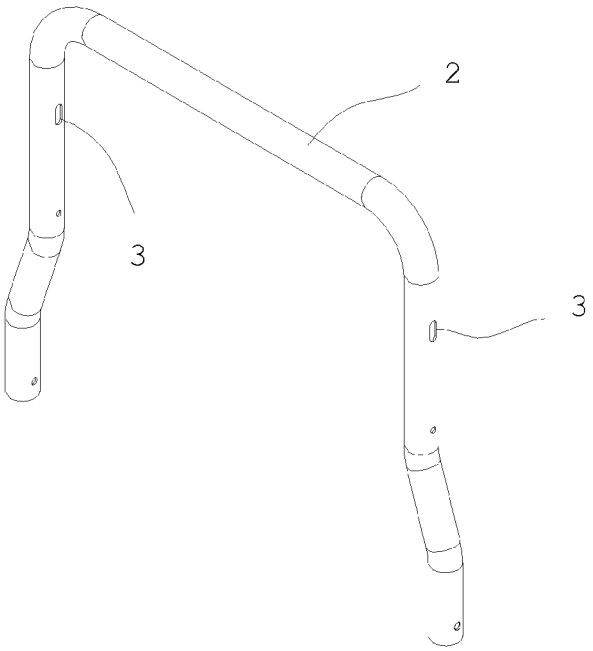
FIG. 5 is a schematic view of a supporting pipe of an embodiment of the present invention.
Figure 6:
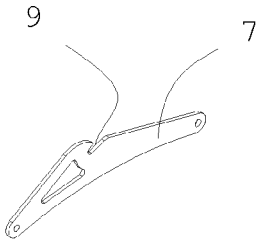
FIG. 6 is a schematic view of a connection piece of an embodiment of the present invention.

Referring to FIGS. 1, 5 and 6, the rollator includes: a base frame 1; front wheel assemblies 4 and rear wheel assemblies 5 respectively mounted on both sides of the base frame 1; an inverted U-shaped supporting pipe 2; a H-shaped armrest bracket 6; a first connection piece 7 and a second connection piece 8, each having a block groove 9 thereon; a slide control lever 10 for cooperating with the block grooves 9; a seat plate 11; a spring element 12. Bottom ends of both side arms of the supporting pipe 2 are hinged to the base frame 1, and both side arms of the supporting pipe 2 are provided with slide holes 3 facing each other. The base frame 1 is provided with unidirectional hinged seats 32 at two ends. The armrest bracket 6 has bottom portions respectively hinged to the unidirectional hinged seats 32. A first T-shaped hinged piece 29 and a second T-shaped hinged piece 30 are respectively fixed on both ends of the middle transverse lever. One end of the connection piece 7 is connected to the first hinged piece 29, while the other end is hinged to the supporting pipe 2 at a position below the slide holes 3. One end of the second connection piece 8 is hinged to the second hinged piece 30, and the other end is hinged to the other side of the supporting pipe 2 at a position below the slide holes 3. Both ends of the slide control lever 10 are respectively received in the slide holes 3 on both side arms of the supporting pipe 2. The spring element 12 is arranged in the side arm of the supporting pipe 2, and one end of the spring element is fixed on the supporting pipe 2, while the other end is fixed on the slide control lever 10. One end of the seat plate 11 is hinged to the first hinged piece 29 and the second hinged piece 30, while the other end is a free end leaning on the supporting pipe 2. The first armrest pipe 13 and the second armrest pipe 14 are respectively sleeved on two sides of the armrest bracket 6, and P-shaped armrests are respectively mounted on the first armrest pipe 13 and the second armrest pipe 14.

A shelf 15 is provided on the bottom of the armrest bracket 6. The shelf 15 includes a U-shaped bracket pipe 16 and a stand pipe 17. Both ends of the bracket 16 are respectively hinged to the first hinged piece 29 and the second hinged piece 30. The bracket pipe 16 is mounted with protrusions 31 for leaning on the base frame 1 to support the shelf. The stand pipe 17 is at the lower portion of the shelf and can support the shelf on the ground.

Figure 2:
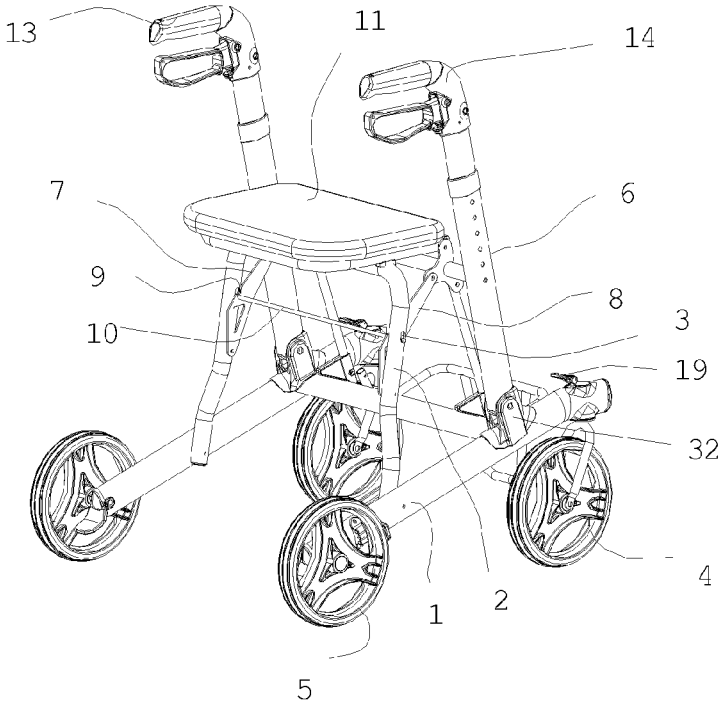
FIG. 2 is a schematic view of a rollator according to an embodiment of the present invention in unfolded state.

Referring to FIG. 2, a rollator in unfolded state is shown. The slide control lever 10 is engaged in the block grooves 9 of both the connection piece 7 and the second connection piece 8 under the action of the spring force of the spring element. In this way, the connection piece 7 and the second connection piece 8 are fixed such that the corresponding supporting pipe 2 and the armrest bracket 6 can not be moved with respect to each other, and the armrest bracket 6 is limited from rotating forwards by the unidirectional hinged seat 32. In this manner, the supporting pipe and the armrest bracket 6 are fixed on the base frame 1, the seat plate 11 is supported between the armrest bracket 6 and the supporting pipe to enable the user to sit thereon, and the rollator can be moved forwards and backwards via the front wheel assemblies 4 and the rear wheel assemblies 5.

Figure 3:
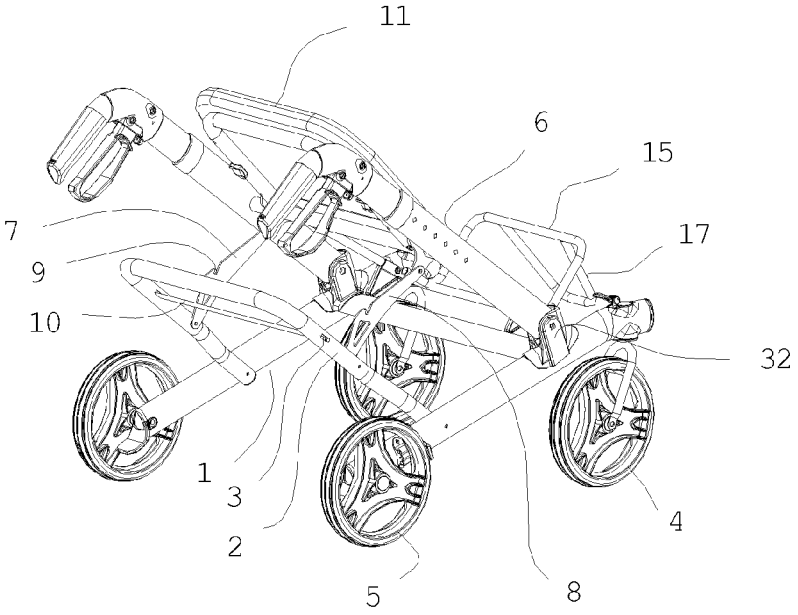
FIG. 3 is a schematic view of a rollator according to an embodiment of the present invention in folded state.

Referring to FIG. 3, a rollator in folded state is shown. Both ends of the slide control lever 10 are released from the block groove 9 on the connection piece 7 and the block groove 9 on the second connection piece 8 after overcoming the spring force of the spring element, and in this way, the connection piece 7 and the second connection piece 8 can be moved freely, the corresponding supporting pipe 2 and the armrest bracket 6 are then moved backwards together, and the seat plate 11 is rotated, so that the rollator is folded backwards. The width of the rollator is remained the same, but the height of the rollator is reduced. The folded rollator thus forms a platform cart which can be used for carrying articles or can be pushed forwards only through the front wheel assemblies after moving the rollator body to an upright position.

Figure 4:
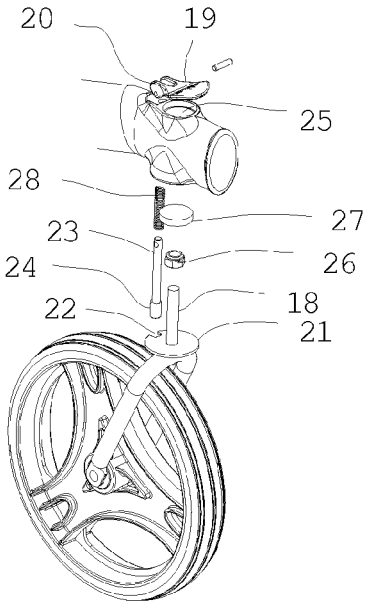
FIG. 4 is a schematic view of a front wheel assembly according to an embodiment of the present invention.

Referring to FIG. 4, the front wheel assembly 4 includes a wheel shaft 18 mounted on the base frame 1. The base frame 1 is provided with a shaft hole 25, the wheel shaft 18 is received in the shaft hole 25 in which a stepped portion is provided. A nut 26 is mounted on the wheel shaft 18 to support the wheel shaft 18 in the shaft hole 25 such that the wheel shaft 18 can be rotated by 360 degree. The cover 27 can be used for sealing the shaft hole 25. In this embodiment, a direction limiter is mounted between the wheel shaft and the base frame to regulate the movement direction of the front wheel assembly such that it can be rotated by 360 degree in unfolded state and be limited in a single direction when being moved to an upright position and then pushed forwards in folded state. The direction limiter includes a follower 21 having a recess 22 mounted on the wheel shaft 18, a button 19 having a cam portion 20, a control rod 23 and a spring 28. The top end of the control rod 23 extends through the base frame 1 and is hinged to the cam portion 20 of the button 19; the stepped portion 24 at the bottom end of the control rod 23 is cooperated with the recess 22. One end of the spring 28 is mounted on the base frame 1, while the other end of the spring 28 is mounted on the control rod 23. The cam portion 20 of the button 19 can be rotated on the base frame 1, the control rod 23 is hinged to the cam portion 20 of the button 19, and can be moved up and down in vertical direction while the cam portion 20 is rotated. The control rod 23 and the button 19 can be stably maintained at the base frame 1 under the action of the spring force, and when the stepped portion 24 is moved to the recess 22 of the follower 21, the rotation of the wheel shaft 18 is limited to realize the position limitation in a single direction. In this way, the front wheel assembly can be limited in the direction of moving forwards and backwards when the folded rollator is moved to an upright position to be pushed forwards.

Because the shelf 15 is hinged to the armrest bracket 6, it can be still rotated to a state in which the stand pipe 17 contacts with the ground to balance the rollator.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

What is claimed is:

1. A rollator, comprising:

a base frame;

front wheel assemblies and rear wheel assemblies respectively mounted on both sides of the base frame;

an inverted U-shaped supporting pipe having a pair of side arms;

an H-shaped armrest bracket;

connection pieces having block grooves thereon;

a slide control lever for cooperating with the block grooves;

a seat plate; and a spring element;

wherein the base frame is provided with unidirectional hinged seats; both bottom ends of the supporting pipe are hinged to the base frame, and both side arms of the supporting pipe are provided with slide holes facing each other; the armrest bracket has bottom portions respectively hinged to the unidirectional hinged seats;

one end of each of the connection pieces is connected to the armrest bracket, while the other end of each of the connection pieces is hinged to the supporting pipe at a position below the slide holes; both ends of the slide control lever are respectively received in the slide holes on both side arms of the supporting pipe; one end of the spring element is mounted on the supporting pipe, while the other end is mounted on the slide control lever; one end of the seat plate is hinged to the armrest bracket, while the other end is a free end leaning on the supporting pipe.

2. The rollator of claim 1, wherein the rollator further comprises a shelf hinged to a bottom portion of the armrest bracket on both sides.

3. The rollator of claim 1, wherein each of the front wheel assemblies comprises a wheel shaft mounted on the base frame with a direction limiter therebetween.

4. The rollator of claim 3, wherein the direction limiter comprises a follower having a recess mounted on the wheel shaft, a button having a cam portion, a control rod and a spring, wherein one end of the control rod extends through the base frame and is hinged to the cam portion of the button, the other end of the control rod is cooperated with the recess; one end of the spring is mounted on the base frame, while the other end of the spring is mounted on the control rod.

5. The rollator of claim 4, wherein a stepped portion is provided on an end of the control rod for cooperating with the recess.

* * * * *